United States Patent [19]

Mezger

[11] Patent Number: 4,593,655

[45] Date of Patent: Jun. 10, 1986

[54] VALVE SEAT RING COOLING APPARATUS

[75] Inventor: Hans Mezger, Freiberg, Fed. Rep. of Germany

[73] Assignee: Dr. Ing. H.c.F. Porsche Aktiengesellschaft, Fed. Rep. of Germany

[21] Appl. No.: 717,020

[22] Filed: Mar. 28, 1985

[30] Foreign Application Priority Data

Mar. 31, 1984 [DE] Fed. Rep. of Germany ..... 3412052

[51] Int. Cl.[4] ..... F01P 3/14

[52] U.S. Cl. ..... 123/41.77; 123/188 GC; 123/41.85

[58] Field of Search ..... 123/188 GC, 41.85, 41.31, 123/41.34, 41.41, 41.76, 41.77, 41.78

[56] References Cited

U.S. PATENT DOCUMENTS

| | | | |
|---|---|---|---|
| 2,078,499 | 4/1937 | Livingstrom | 123/41.76 |
| 2,166,331 | 7/1939 | Waeber | 123/41.76 |
| 2,216,802 | 10/1940 | Baster | 123/41.77 |
| 3,353,522 | 11/1967 | Ley | 123/41.85 |
| 4,008,695 | 2/1977 | Bouquet | 123/188 GC |
| 4,169,488 | 10/1979 | Goloff et al. | 123/188 GC |
| 4,200,066 | 4/1980 | Berchtold | 123/188 GC |
| 4,341,185 | 7/1982 | Pollet | 123/188 GC |
| 4,522,161 | 6/1985 | Slee | 123/188 GC |

FOREIGN PATENT DOCUMENTS

| | | | |
|---|---|---|---|
| 3205676 | 9/1982 | Fed. Rep. of Germany | 123/188 GC |
| 1129595 | 1/1957 | France | 123/188 GC |
| 23214 | 2/1983 | Japan | 123/188 GC |

*Primary Examiner*—Ira S. Lazarus

*Attorney, Agent, or Firm*—Barnes & Thornburg

[57] ABSTRACT

An apparatus for cooling valve seat rings which are arranged in a cylinder head of an internal-combustion engine, the valve seat rings being surrounded by annular ducts through which a cooling medium can flow. For the forced circulation of the cooling medium in the annular ducts of the valve seat rings, a first guiding duct is connected to feeding lines of the annular ducts and to the output side of a pump and a second guiding duct is connected to discharge lines and to the intake side of the pump.

7 Claims, 3 Drawing Figures

VALVE SEAT RING COOLING APPARATUS

BACKGROUND AND SUMMARY OF THE INVENTION

This invention relates to a cooling apparatus for valve seat rings provided in a cylinder head of an internal-combustion engine, the valve seat rings being surrounded by annular ducts through which a liquid cooling medium flows that is delivered by a pump, the annular ducts having feeding and discharge lines that are connected with guiding ducts to circulate the cooling medium.

According to German Patent Publication No. 1,576,727, a valve seat ring cooling apparatus is known. However, in that publication, a steady flow of cooling medium will be difficult to maintain with the apparatus suggested because no pressure cooling medium conveying device or cooling medium guiding system is disclosed.

One objective of the present invention is to provide a cooling apparatus for the valve seat rings of an internal-combustion engine where an optimal flow of cooling medium through the annular ducts surrounding the valve seat rings is achieved.

According to the present invention, an improved apparatus for the feeding and discharge of the cooling medium is provided which results in a forced circulation of the cooling medium in the annular ducts surrounding the valve seat rings and therefore a good cooling of these valve seat rings is achieved. By connecting a second guiding duct to the intake side of the pump, a separation of the cooling medium of the valve seat rings from the cooling medium of the internal-combustion engine results because of the relatively high difference in pressure between the feeding lines and the discharge lines which provides good circulation of the cooling medium.

The installation of the second guiding duct and also of the discharge lines in the cylinder head is easy to carry out by known manufacturing techiques. By using a pipe section between the cylinder head and the pump, a simple connection of the second guiding duct to the pump is provided. The design of the pipe section where it connects with the intake branch of the pump provides a good discharge of the cooling medium from the second guiding duct which increases the pressure differential.

A surface enlargement of the valve seat rings in the annular duct contributes to an improved cooling effect. Finally, the discharge lines and also the second guiding duct, at least in a new conception of an internal-combustion engine, would be easy to manufacture and open new constructive possibilities.

Further objects, features, and advantages of the present invention will become more apparent from the following description when taken with the accompanying drawings which show, for purpose of illustration only, an embodiment in accordance with the present invention.

DETAILED DESCRIPTION OF THE DRAWINGS

Figure 1:
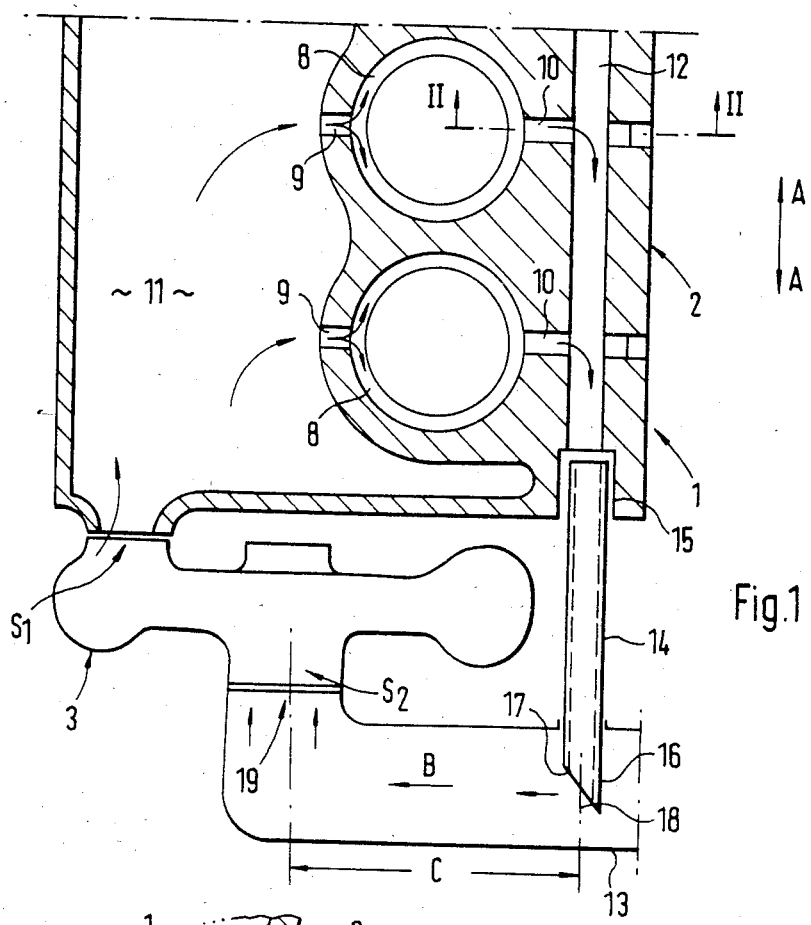
FIG. 1 is a diagrammatic partial top view of an internal-combustion engine having a cooling apparatus according to the invention.
Figure 2:
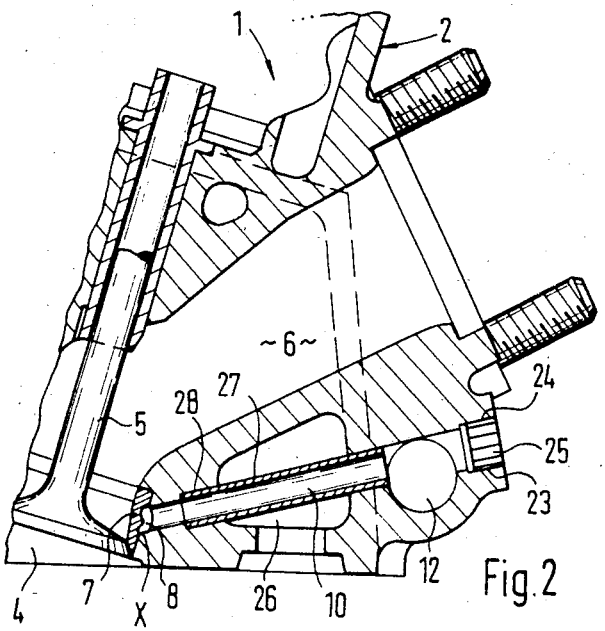
FIG. 2 is a sectional view along Line II—II of FIG. 1.

A cylinder head 2 is shown as part of a four-cycle internal-combustion engine 1 which is liquid-cooled and for this purpose includes a pump 3 for delivering a cooling medium.

For the control of the gas exchange in a combustion chamber 4, the cylinder head has valves 5 which in this embodiment are assigned to an outlet duct 6. Two valves 5 are provided in the outlet duct 6, therefore the gas exchange in this internal-combustion engine takes place by means of at least three valves, the third valve being located in an inlet duct which is not shown.

Each valve 5 has a valve seat ring 7 that is surrounded by an annular duct 8. When the internal-combustion engine is in operation, a cooling medium circulates in this annular duct 8, the cooling medium being the same as the cooling medium used for the cooling of the internal-combustion engine.

For this circulation, the circular annular duct 8 is provided with a feeding line 9 and a discharge line 10 which are opposite one another and are arranged on the center line of the annular duct 8. The feeding line 9 is connected to a first guiding duct 11 which is connected to the outlet side $S_1$ of the pump 3. Other cooling ducts for the actual cooling of the cylinder head 2 and other parts of the internal-combustion engine 1 are also supplied with the cooling medium via the first guiding duct 11.

The discharge line 10 leads into a second guiding duct 12 that is connected to the intake side $S_2$ of the pump 3. The second guiding duct 12 is formed by a channel extending in the longitudinal direction A-A of the internal-combustion engine 1, the discharge line 10 being perpendicular to the second guiding duct 12.

A first pipe section 14 is provided between the second guiding duct 12 and the pump 3 or an intake branch 13 of the pump 3. This first pipe section 14, on one side, is inserted in a leakproof manner into a first bore 15 of the cylinder head 2, and, on the other side, with a section 16, projects into the intake branch 13. The section 16 is provided with an angled portion 17 which faces in the direction B of the flow of the cooling medium conveyed to the pump 3. The entry of the cooling medium leaving the second guiding duct 12 into the pump 3 takes place at position 18, which is relatively close (distance C) to the pump inlet 19.

Figure 3:
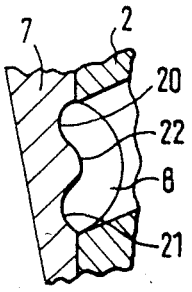
FIG. 3 is an exploded view of area X of FIG. 2.

According to FIG. 3, two depressions 20, 21 and one raised portion 22 are provided on the valve seat ring 7 in the area of the annular duct 8 to enlarge the surface area to provide better cooling. The depressions 20, 21 and the raised portion 22 surround the valve seat ring 7.

The discharge line 10 is formed by a second bore 23 in the cylinder head 2 with an opening 24 on the exterior side of the cylinder head being sealed by a pressed-in part 25. The discharge line 10 leads through a cylinder head cooling duct 26 which is bridged by a second pipe section 27 that is pressed into a third bore 28 in the cylinder head.

Although the invention has been described in detail with reference to a preferred embodiment and specific examples, variations and modifications exist within the scope and spirit of the invention as described and defined in the following claims.

What is claimed is:

1. An arrangement for cooling valve seat rings provided in a cylinder head of an internal-combustion engine having an engine cooling system, said valve seat rings being surrounded by annular ducts through which a liquid cooling medium can be circulated, a pump for circulating the liquid cooling medium, feeding and discharge lines that are connected to the annular ducts, the improvement comprising:

said pump being connected to supply said cooling medium to both said annular ducts and said engine cooling system, a first guiding duct connected between an output side of the pump and the feeding lines, and a second guiding duct connected to the discharge lines, a first pipe section connected between said second guiding duct and an inlet branch of an intake side of said pump, said pipe section having an angled portion which projects into said inlet branch, said inlet branch also connecting said engine cooling system to said intake side of the pump, wherein said arrangement provides a forced circulation of the cooling medium through the annular ducts of the valve ring seats in parallel to said engine cooling system with respect to said pump.

2. The cooling apparatus of claim 1, wherein a longitudinal channel in the cylinder head forms the second guiding duct and wherein the discharge lines are connected into the second guiding duct in a substantially perpendicular relation.

3. The cooling apparatus of claim 1, wherein the valve seat ring has a raised portion interposed between two depressions to increase the surface area of the annular ducts.

4. The cooling apparatus of claim 1, wherein a bore in the cylinder head forms each discharge line.

5. The cooling apparatus of claim 4, wherein the discharge line includes a second pipe section to penetrate a cooling duct in the cylinder head.

6. The cooling apparatus of claim 4, further comprising a pressed-in part to seal the outer portion of the bore forming the discharge line.

7. The cooling apparatus of claim 6, wherein seat angled portion of said first pipe section includes an angled orifice, said angled orifice facing downstream the direction of flow of the cooling medium.

* * * * *